US006268694B1

(12) United States Patent
Fujimoto

(10) Patent No.: US 6,268,694 B1
(45) Date of Patent: Jul. 31, 2001

(54) COLD CATHODE FLUORESCENT LAMP, BACK-LIGHT EMITTING DEVICE WITH THE COLD CATHODE FLUORESCENT LAMP AND NOTE-TYPE PERSONAL COMPUTER WITH THE BACK-LIGHT EMITTING DEVICE

(75) Inventor: Kazushi Fujimoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/181,622

(22) Filed: Oct. 29, 1998

(30) Foreign Application Priority Data

Oct. 31, 1997 (JP) ..... 9-316103

(51) Int. Cl.[7] ..... H01J 1/62; H01J 63/04; H01J 17/02; H01J 61/02; H01J 17/04

(52) U.S. Cl. ..... 313/491; 313/492; 313/493; 313/631; 313/632; 313/634; 313/635; 313/610; 313/611; 313/622; 313/623

(58) Field of Search ..... 313/610, 611, 313/600, 595, 621, 622, 623, 492, 493, 634, 631–632; 315/169.1, 169.3; 362/29, 30, 26, 31, 260

(56) References Cited

U.S. PATENT DOCUMENTS

| | | | |
|---|---|---|---|
| 2,265,323 | 12/1941 | Spanner | 176/124 |
| 2,802,968 | 8/1957 | Knott | 315/235 |

(List continued on next page.)

FOREIGN PATENT DOCUMENTS

| | | |
|---|---|---|
| 295 11 221 U | 10/1995 | (DE) . |
| 978 563 | 4/1951 | (FR) . |

(List continued on next page.)

OTHER PUBLICATIONS

Patent Abstracts of Japan, vol. 004, No. 040 (E–004), Mar. 28, 1980.

(List continued on next page.)

*Primary Examiner*—Ashok Patel
*Assistant Examiner*—Mack Haynes
(74) *Attorney, Agent, or Firm*—Sughrue, Mion, Zinn, Macpeak & Seas, PLLC

(57) ABSTRACT

There is provided a cold cathode fluorescent lamp including a transparent tube including first and second light-emitting areas defined by partitioning an inner space of the transparent tube, a first terminal electrode positioned in the first light-emitting area and at a longitudinal end of the first light-emitting area located closer to an end of the tube, a second terminal electrode positioned in the second light-emitting area and at a longitudinal end of the second light-emitting area located closer to the other end of the tube, a first intermediate electrode positioned in the first light-emitting area and at the other longitudinal end of the first light-emitting area, a second intermediate electrode positioned in the second light-emitting area and at the other longitudinal end of the second light-emitting area, a first lead-in wire connected to the first terminal electrode through the longitudinal end of the first light-emitting area, a second lead-in wire connected to the second terminal electrode through the longitudinal end of the second light-emitting area, a third lead-in wire connected to the first intermediate electrode through the other longitudinal end of the first light-emitting area, and a fourth lead-in wire connected to the second intermediate electrode through the other longitudinal end of the second light-emitting area. The above-mentioned cold cathode fluorescent lamp makes it possible to lower a break-down voltage and a discharge voltage down to about halves of them in a conventional fluorescent lamp, and hence, discharged electrons are not attracted to a metal part. Thus, it is possible to prevent a cold cathode fluorescent lamp from not turning on due to electron discharge.

5 Claims, 9 Drawing Sheets

U.S. PATENT DOCUMENTS

| | | | | |
|---|---|---|---|---|
| 4,004,189 | | 1/1977 | Cosco | 315/335 |
| 4,037,128 | | 7/1977 | Levin et al. | 313/188 |
| 5,764,493 | * | 6/1998 | Liao | 362/31 |

FOREIGN PATENT DOCUMENTS

| | | |
|---|---|---|
| 2 298 882 | 8/1996 | (FR) . |
| 2-100685 | 9/1990 | (JP) . |
| HO2-100685 | 9/1990 | (JP) . |
| 5-242868 | 9/1993 | (JP) . |
| HO5-242868 | 9/1993 | (JP) . |
| 6-103962 | 4/1994 | (JP) . |
| HO6-103962 | 4/1994 | (JP) . |
| 6-84670 | 12/1994 | (JP) . |
| 6-84671 | 12/1994 | (JP) . |
| 8-273604 | 10/1996 | (JP) . |

OTHER PUBLICATIONS

Patent Abstracts of Japan, vol. 004, No. 087 (D–016), Jun. 21, 1980.

Patent Abstracts of Japan, Nol. 015, No. 036 (E–1027), Jan. 29, 1991.

M. Kinoshita, Liquid Crystal with Back–Light required for Note–type Personal Computer, Monthly Display, vol. 6, Jun. 1997, pp. 94–100.

A. Ohara, "Status and Problems in Back–Light used for Liquid Crystal Display", Monthly Display, vol. 5, May 1996, pp. 19–27.

* cited by examiner

COLD CATHODE FLUORESCENT LAMP, BACK-LIGHT EMITTING DEVICE WITH THE COLD CATHODE FLUORESCENT LAMP AND NOTE-TYPE PERSONAL COMPUTER WITH THE BACK-LIGHT EMITTING DEVICE

BACKGROUND OF THE INVENTION

1. Field of the Invention

The invention relates to a cold cathode fluorescent lamp suitable for a liquid crystal display, and further to a back-light emitting device having the cold cathode fluorescent lamp, and still further to a note-type personal computer having the back-light emitting device.

2. Description of the Related Art

In these days, a liquid crystal display mounted on a note-type personal computer is required to have 800×600 pixels or 1024×768 pixels both having a high resolution. Along with an increase in a resolution, a liquid crystal display becomes larger in size. For instance, a size of a liquid crystal display screen has changed from 12.1 to 13.3, and then, from 13.3 to 14.1.

However, a note-type personal computer has a restriction that a size thereof does not exceed A4 size or A4 file size. In addition, a note-type personal computer is required to have a smaller weight. As a result, there are many problems to be solved with respect to a liquid crystal display to be mounted on a note-type personal computer.

The first problem is that a liquid crystal display has to have a smaller thickness and a smaller weight.

The second problem is that a distance between a liquid crystal screen and an outer edge of a liquid crystal display is shortened in order to make it possible to incorporate a larger screen into a limited floor area of a note-type personal computer. In other words, a smaller-framed screen is required.

The third problem is that an arrangement of parts except a liquid crystal display, such as an inverter, is altered to thereby prevent an increase in a floor area of a note-type personal computer.

FIGS. 1 and 2 partially illustrate conventional note-type personal computers.

The conventional note-type personal computer illustrated in FIG. 1 is comprised of a first body 16*a* including a structure acting as a computer and an input means such as a keyboard, a second body 16*b* including a display screen 17 which has an outer periphery 15 and on which images are displayed, a hinge structure 11 formed between the first and second bodies 16*a* and 16*b* for connecting the second body 16*b* to the first body 16*a* so that the second body 16*b* is rotatable relative to the first body 16*a*, an inverter 12 housed in the hinge structure 11 almost at the center, and a cold cathode fluorescent lamp 5 housed in the second body 16*b* at a bottom.

The cold cathode fluorescent lamp 5 includes first and second terminal electrodes 1 and 4 at opposite ends. The first terminal electrode 1 is electrically connected to a low voltage cable 10 through both a lead-in wire 6*a* and a thin wire 7, and the low voltage cable 10 is connected to a low voltage terminal 14 of the inverter 12. The second terminal electrode 4 is electrically connected to a high voltage cable 9 through a lead-in wire 6*b*, and the high voltage cable 9 is connected to a high voltage terminal 13 of the inverter 12.

The conventional note-type personal computer illustrated in FIG. 2 has the same structure as that of the note-type personal computer illustrated in FIG. 1. The note-type personal computer illustrated in FIG. 1 is different from the note-type personal computer illustrated in FIG. 2 with respect to a location of a wire port 8 through which low and high voltage cables 9 and 10 extend. Specifically, the second body 16*b* of the note-type personal computer illustrated in FIG. 1 is formed at a bottom corner with the wire port 8, whereas the second body 16*b* of the note-type personal computer illustrated in FIG. 2 is formed at a center of a bottom edge with the wire port 8.

The reasons why it is difficult to render a frame around the display screen smaller are in a conventional note-type personal computer as follows. If a frame around the display screen is made smaller, the cold cathode fluorescent lamp 5 is located just in the close vicinity of, or at the rear of the display screen 17. Hence, when the cold cathode fluorescent lamp 5 is turned on, fluorescent lights pass directly through the display screen 17. In addition, there has to exist a space just below the display screen 17 for housing therein wires connecting the first and second terminal electrodes 1 and 4 to the inverter 12. Hence, the cold cathode fluorescent lamp cannot avoid to be located closer to the display screen 17 by a distance corresponding to the above-mentioned space, which makes it more difficult to form the frame smaller.

As a solution to the above-mentioned problems, there is employed the thin wire having a diameter of about 0.3 mm for connecting the lead-in wire 6*a* and the low voltage cable 10, to thereby narrow the above-mentioned space for locating the cold cathode fluorescent lamp 5 remoter from the display screen 17.

If the display screen 17 is made larger in size, a back-light emitting device has to be made larger accordingly, and as a result, a cold cathode fluorescent lamp as a back-light source has to be made longer accordingly.

A cold cathode fluorescent lamp is presently widely used as a back-light source for a liquid crystal display, because a cold cathode fluorescent lamp has many advantages that it generates a small amount heat, it has a relatively long lifetime, and an electrode structure is simple, and hence is able to be formed smaller, contributing to formation of a liquid crystal display in a smaller size.

However, if a cold cathode fluorescent lamp were designed to have a smaller diameter and a longer length, a break-down voltage and a discharge voltage would be both increased. Specifically, if a display screen has a width across corners of 14 inches, a cold cathode fluorescent lamp would have a length exceeding 280 mm, and a break-down voltage and a discharge voltage of a cold cathode fluorescent lamp having a diameter of 2.0 mm would reach about 1200 Vrms and 650 Vrms, respectively.

A hot cathode fluorescent lamp has a lower discharge voltage than that of a cold cathode fluorescent lamp, but has shortcomings that a filament electrode emitting thermoelectrons which cause light-emission generates heat, a hot cathode fluorescent lamp cannot be formed smaller in diameter because electrodes cannot be formed smaller in size, and a hot cathode fluorescent lamp has a short lifetime. Accordingly, a hot cathode fluorescent lamp is scarcely used as a backlight source of a liquid crystal display used for a note-type personal computer.

As mentioned earlier, the note-type personal computer illustrated in FIG. 1 employs the thin wire 7 for connecting the lead-wire 6*a* to the low voltage cable 10 in order to make a frame around the display screen 17 smaller. However, since the high and low voltage cables 9 and 10 are designed to extend through the wire port 8 formed a t a corner of the second body 16*b*, there is paused a problem that those high and low voltage cables 9 and 10 cause the second body 16*b* larger in size.

The reason is as follows. The high voltage cable 9 has to have a high resistance to high voltages, and hence, cannot avoid to have a relatively large diameter. For this reason, if the wire port 8 through which the high voltage cable 9 is introduced is formed at a corner of the second body 16*b*, it would be necessary to make a space A between the second body 16*b* and the outer periphery 15 of the display screen 17 for housing the cables 9 and 10 therein. As a result, the second body 16*b* cannot avoid to become larger in size to a degree corresponding to the space A.

In the note-type personal computer illustrated in FIG. 2, the wire port 8 through which the high and low voltage cables 9 and 10 are introduced is formed at a center of a bottom edge of the second body 16*b*. Hence, a space for housing the high and low voltage cables 9 and 10 therein, such as the space A illustrated in FIG. 1, is cancelled by the hinge structure 11, and thus, the above-mentioned problem about the space A is solved in the note-type personal computer illustrated in FIG. 2.

However, the note-type personal computer illustrated in FIG. 2 is accompanied with a problem that it is impossible to form a frame around the display screen 17 smaller due to the formation of the wire port 8 at the center of the bottom edge of the second body 16*b*.

The reason is as follows. The high voltage cable 9 is required to have a relatively large diameter in order to withstand high voltages. Hence, the note-type personal computer has to form a space B for housing the high voltage cable 9 therein. The space B is longer than the space A illustrated in FIG. 1. Hence, the second body 16*b* cannot avoid to become larger in size to a degree corresponding to the space B.

As explained so far, it is quite difficult or almost impossible in the conventional note-type personal computer to concurrently accomplish formation of a smaller frame around the display screen 17 and prevention of the second body 16*b* from becoming larger in size.

In addition, if the cold cathode fluorescent lamps used in the conventional note-type personal computer illustrated in FIGS. 1 and 2 are formed long, it would be difficult to design an insulating structure around the electrodes 1 and 4, and make the inverter 12 in a smaller size.

The reason is as follows. If a cold cathode fluorescent lamp is formed long, a break-down voltage and a discharge voltage are both increased, resulting in that discharged electrons tend to be attracted to a metal located in the vicinity of the cold cathode fluorescent lamp. Thus, it would be quite difficult to completely insulate the electrodes from surroundings.

In addition, the inverter 12 has to have a great step-up ratio in order to emit a greater output voltage. A step-up ratio of an electromagnetic transformer is in dependence on the number of turns of copper wires wound around a core.

Hence, if a step-up ratio is to be increased, the number ratio of copper wire turns becomes greater, resulting in that an electromagnetic transformer cannot avoid becoming larger in size.

Japanese Unexamined Utility Model Publications Nos. 6-84670 and 6-84671 have suggested a multi-electrode fluorescent lamp, which is illustrated in FIG. 3. The suggested multi-electrode fluorescent lamp is comprised of a glass tube 21 having a main portion 21*a* and a projected portion 21*b*, a first terminal electrode 1 fixed at an end of the main portion 21*a* by means of a first base 20*a*, a second terminal electrode 4 fixed at the other end of the main portion 21*b* by means of a second base 20*b*, an intermediate terminal 19 fixed at an end of the projected portion 21*b* by means of a third base 20*c*, and a first lead-in wire 6*a* connected to the first terminal electrode 1 through the first base 20*a*, a second lead-in wire 6*b* connected to the second terminal electrode 4 through the second base 20*b*, and a third lead-in wire 6*c* connected to the intermediate electrode 19 through the third base 20*c*.

The above-mentioned multi-electrode fluorescent lamp has a problem that the electrodes 1, 4, and 19 occupy a large space, which prevents a frame around the display screen 17 from becoming smaller.

The reason is as follows. As illustrated in FIG. 3, the intermediate electrode 19 is positioned in the projected portion 21*b* of the glass tube 21, and is fixed to the projected portion 21*b* by means of the third base 20*c*. The presence of the projected portion 21*b* and the third base 20*c* causes a frame around the display screen 17 to become larger in size.

In addition, above-mentioned multi-electrode fluorescent lamp further has a problem that it is quite difficult to design the lamp to have a smaller diameter, because the electrodes 1, 4, and 19 are in the form of a hot cathode fluorescent lamp.

The reason is as follows. An electrode used in a hot cathode fluorescent lamp is comprised of a filament electrode for emitting thermoelectrons. Hence, each of the bases 20*a*, 20*b*, and 20*c* have to have two pins as terminals to connect to the electrodes 1, 14, and 19, respectively. As a result, a large space is required to arrange the filament electrode and the associated base, and accordingly, it is difficult to make a diameter of the lamp smaller.

Japanese Unexamined Patent Publication No. 8-273604 has suggested a planar fluorescent lamp. FIG. 4 is a cross-sectional view of the suggested planar fluorescent lamp, and FIG. 5 is a cross-sectional view taken along the line V—V in FIG. 4.

The suggested planar fluorescent lamp is comprised of a hermetically sealed container 30, a first terminal electrode 1 having a length almost equal to a height of the container 30, and located at an end of the container 30, a second terminal electrode 4 having a length almost equal to a height of the container 30, and located at the other end of the container 30, a central electrode 19 having a length almost equal to a height of the container 30, and positioned at the center between the first and second terminal electrodes 1 and 4, lead-in wire pairs 6 each connected to the electrodes 1, 4, and 19 at opposite ends, an inverter 12, a high voltage cable 9 connecting the central electrode 19 to a high voltage terminal 13 of the inverter 12, and a low voltage cable 10 connecting the first and second terminal electrodes 1 and 4 to a low voltage terminal 14 of the inverter 12.

However, the above-mentioned planar fluorescent lamp is accompanied with a problem that it does not contribute to formation of a liquid crystal display in a smaller size and a smaller weight.

The reason is as follows. In general, a pressure in a fluorescent lamp is seven to eight times smaller than an atmospheric pressure. Specifically, a pressure in a fluorescent lamp is in the range of about 90 to about 100 Torr, whereas an atmospheric pressure (1 atm) is equal to 760 Torr. Hence, when a large surface light source is to be formed, it is necessary for both a front glass panel 22 and a rear glass panel 23 to have a certain thickness for having a sufficient strength in order to keep an inner gap of the container 30 constant, even if an external pressure acts on the container 30. As a result, a liquid crystal display including the container 30 having a thick outer wall and a heavy weight cannot be formed thinner and lighter.

Masaki Kinoshita has discussed characteristics required for a liquid crystal display in "Liquid Crystal with Back-Light required for Note-type Personal Computer", Monthly "Display", Vol.6, pp. 94–100, June 1997. According to this article, a back-light emitting device used for liquid crystal module is required to have a relatively long lifetime, a low power consumption rate, a smaller thickness, a smaller weight, and a smaller frame around a display screen. A minimum frame is about 4 mm.

Akio Obara has discussed requirements for a back-light emitting device, and compared a hot cathode fluorescent lamp to a cold cathode fluorescent lamp to be used for a back-light source, in "Status and Problems in Back-Light used for Liquid Crystal Display", Monthly "Display", Vol. 5, pp. 19–27, May 1996.

SUMMARY OF THE INVENTION

In view of the above-mentioned problems of a cold cathode fluorescent lamp used in the conventional note-type personal computer, it is an object of the present invention to provide a cold cathode fluorescent lamp which is capable of narrowing a space for housing wires therein to thereby make it possible to form a frame around a display screen smaller without allowing a personal computer to become larger in size, and further of forming a high voltage cable as short as possible to thereby prevent abnormal discharge.

Another object of the present invention is to provide a cold cathode fluorescent lamp which is capable of lowering both a break-down voltage and a discharge voltage, even if a cold cathode fluorescent lamp is formed longer, to thereby remove difficulty in designing an insulating structure around electrodes of a cold cathode fluorescent lamp, and an inverter.

A further object of the present invention is to provide a cold cathode fluorescent lamp which is capable of being used for a large-sized back-light emitting device without an output voltage of an inverter being increased.

It is also an object of the present invention to provide a back-light emitting device and a note-type personal computer accomplishing the same as mentioned above.

In one aspect, there is provided a cold cathode fluorescent lamp including (a) a transparent tube including first and second light-emitting areas defined by partitioning an inner space of the transparent tube, (b) a first terminal electrode positioned in the first light-emitting area and at a longitudinal end of the first light-emitting area located closer to an end of the transparent tube, (c) a second terminal electrode positioned in the second light-emitting area and at a longitudinal end of the second light-emitting area located closer to the other end of the transparent tube, (d) a first intermediate electrode positioned in the first light-emitting area and at the other longitudinal end of the first light-emitting area, (e) a second intermediate electrode positioned in the second light-emitting area and at the other longitudinal end of the second light-emitting area, (f) a first lead-in wire connected to the first terminal electrode through the longitudinal end of the first light-emitting area, (g) a second lead-in wire connected to the second terminal electrode through the longitudinal end of the second light-emitting area, (h) a third lead-in wire connected to the first intermediate electrode through the other longitudinal end of the first light-emitting area, and (i) a fourth lead-in wire connected to the second intermediate electrode through the other longitudinal end of the second light-emitting area.

It is preferable that the inner space of the transparent tube is partitioned at the center, and the first and second light-emitting areas extend to longitudinal ends of the transparent tube.

It is preferable that the third and fourth lead-in wires form a T-shaped wire. It is also preferable that a distance between the first terminal electrode and the first intermediate electrode is equal to a distance between the second terminal electrode and the second intermediate electrode.

In another aspect of the present invention, there is provided a back-light emitting device including (a) a light guide plate, and (b) a cold cathode fluorescent lamp positioned adjacent to an end surface of the light guide plate, the cold cathode fluorescent lamp including (a) a transparent tube including first and second light-emitting areas defined by partitioning an inner space of the transparent tube at the center, and extending to longitudinal ends of the transparent tube, (b) a first terminal electrode positioned in the first light-emitting area and at a longitudinal end of the first light-emitting area located closer to an end of the transparent tube, (c) a second terminal electrode positioned in the second light-emitting area and at a longitudinal end of the second light-emitting area located closer to the other end of the transparent tube, (d) a first intermediate electrode positioned in the first light-emitting area and at the other longitudinal end of the first light-emitting area, (e) a second intermediate electrode positioned in the second light-emitting area and at the other longitudinal end of the second light-emitting area, (f) a first lead-in wire connected to the first terminal electrode through the longitudinal end of the first light-emitting area, (g) a second lead-in wire connected to the second terminal electrode through the longitudinal end of the second light-emitting area, (h) a third lead-in wire connected to the first intermediate electrode through the other longitudinal end of the first light-emitting area, and (i) a fourth lead-in wire connected to the second intermediate electrode through the other longitudinal end of the second light-emitting area, a lower level voltage being applied to the first and second terminal electrodes, and a higher level voltage being applied to the first and second intermediate electrodes.

In still another aspect of the present invention, there is provided a personal computer including (a) a first body including a structure acting as a computer, (b) a second body including a liquid crystal display screen, (c) a hinge structure for connecting the second body to the first body so that the second body is rotatable relative to the first body, (d) an inverter positioned in the hinge structure and occupying either half of inner space of the hinge structure, (e) a cold cathode fluorescent lamp housed in the second body, the cold cathode fluorescent lamp including (e-1) a transparent tube including first and second light-emitting areas defined by partitioning an inner space of the transparent tube at the center, and extending to longitudinal ends of the transparent tube, (e-2) a first terminal electrode positioned in the first light-emitting area and at a longitudinal end of the first light-emitting area located closer to an end of the transparent tube, (e-3) a second terminal electrode positioned in the second light-emitting area and at a longitudinal end of the second light-emitting area located closer to the other end of the transparent tube, (e-4) a first intermediate electrode positioned in the first light-emitting area and at the other longitudinal end of the first light-emitting area, and (e-5) a second intermediate electrode positioned in the second light-emitting area and at the other longitudinal end of the second light-emitting area, (e-6) a first lead-in wire connected to the first terminal electrode through the longitudinal end of the first light-emitting area, (e-7) a second lead-in wire connected to the second terminal electrode through the longitudinal end of the second light-emitting area, (e-8) a third lead-in wire connected to the first intermediate electrode through the other longitudinal end of the first light-emitting area, and (e-9) a fourth lead-in wire connected to the second intermediate electrode through the other longitudinal end of the second light-emitting area, and (f) connection wires for connecting the first and second lead-in wires to the inverter through a wire port formed at the second body.

It is preferable that each of the connection wires has a smaller thickness than thicknesses of the first and second lead-in wires. It is also preferable that each of the connection wires is comprised of a foil-shaped electrical conductor, and an insulator covering the foil-shaped electrical conductor therewith. It is preferable that the wire port is formed at the center of a bottom of the second body. It is preferable that the first and second intermediate electrodes are electrically connected to high level terminals of the inverter, and the first and second terminal electrodes are electrically connected to low level terminals of the inverter.

The advantages obtained by the aforementioned present invention will be described hereinbelow.

The first advantage is that since a break-down voltage and a discharge voltage in the cold cathode fluorescent lamp in accordance with the present invention is about half of those in a conventional cold cathode fluorescent lamp, discharged electrons are never attracted from the electrodes to metal located in the vicinity of the electrodes the cold cathode fluorescent lamp. Hence, it is possible to prevent a cold cathode fluorescent lamp from not turning on due to discharge.

The reason is as follows. In the cold cathode fluorescent lamp in accordance with the present invention, a low level voltage is applied to the terminal electrodes, whereas a high level voltage is applied to the intermediate electrodes. As a result, a discharge distance in the inventive cold cathode fluorescent lamp is about a half of a discharge distance in a conventional cold cathode fluorescent lamp having electrodes only at opposite ends, assuming the inventive and conventional cold cathode fluorescent lamps have the same length.

The second advantage is that a small-sized step-up component can be used without an increase in an output voltage of an inverter, and hence, it is possible to form an inverter in a smaller size.

The reason why a component having a high step-up ratio is no longer necessary to be used is that it is no longer necessary to increase an output voltage of an inverter connected to a cold cathode fluorescent lamp, because both a break-down voltage and a discharge voltage are lowered. A step-up ratio is in dependence on a number ratio of turns of copper wires wound around a core in an electromagnetic transformer. The greater a number ratio is, the greater a step-up ratio is, and hence, a larger a step-up component is in size. Accordingly, the smaller a step-up ratio is, the smaller a step-up component is, which makes it possible to form an inverter in a smaller size.

The third advantage is that since a low level voltage is applied to the terminal electrodes of the cold cathode fluorescent lamp, there can be used a wire having a small thickness and a low resistance to a high voltage, as a cable to be housed in a liquid crystal display. This ensures a smaller frame around a display screen.

The reason is as follows. The thin wire to be used in the present invention is comprised of a foil-like electrical conductor, and an insulator with which the foil-like electrical conductor is covered. Hence, the thin wires are spaced away from each other by a gap of about 0.5 mm, for instance. A conventional cold cathode fluorescent lamp uses a wire comprised of an electrical conductor formed by twisting strands, and an insulator with which the electrical conductor is covered. The thin wire used in the present invention makes it possible to omit a space for housing a wire therein in comparison with a wire used in a conventional cold cathode fluorescent lamp. In addition, since a high level voltage is applied to the intermediate electrodes, it is not necessary to form the high voltage cable longer, which prevents abnormal discharge caused by a long cable, and facilitates a smaller frame around a display screen.

The fourth advantage is that it is possible to accomplish a smaller frame around a display screen, which could not be accomplished in a conventional note-type personal computer, even though a wire port thorough which a cable is introduced is formed at the center of a side edge of a personal computer, in a edge light type surface light source including the cold cathode fluorescent lamp in accordance with the present invention.

In addition, since the wire port is located at the center of a side edge of a personal computer, a space for housing cables extending from the second body can be cancelled with the hinge structure, which ensures prevention of a floor area of a personal computer from becoming larger.

The fifth advantage is that the two intermediate electrodes each forming a light emitting section share a lead-in wire, which reduces the number of lead-in wires, and which makes it no longer necessary to prepare a plurality of inverters for each of light emitting sections.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 6:
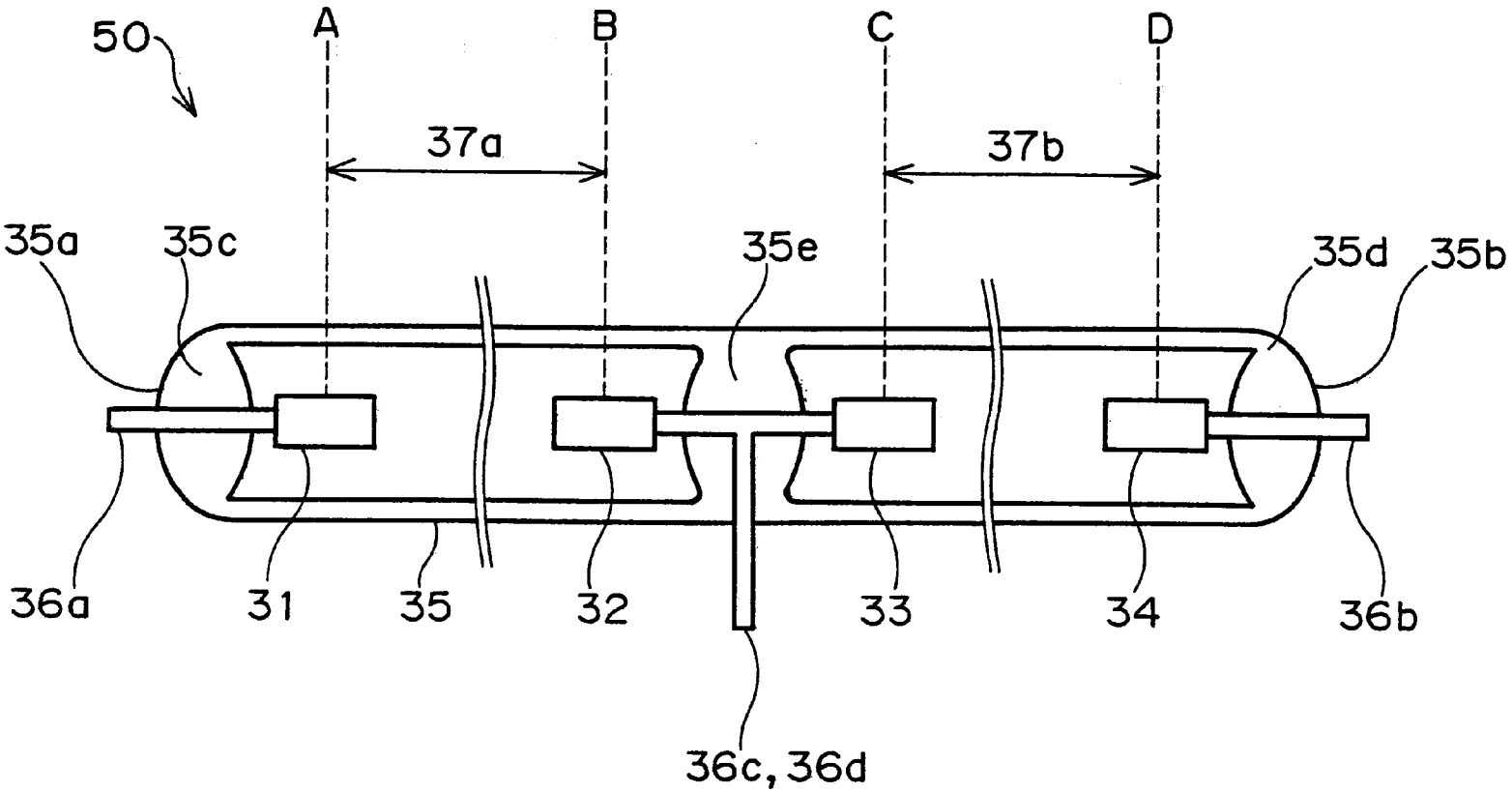
FIG. 6 is a front view illustrating a cold cathode fluorescent lamp in accordance with a preferred embodiment of the present invention.

FIG. 6 illustrates a cold cathode fluorescent lamp in accordance with an embodiment of the present invention.

The cold cathode fluorescent lamp 30 includes a transparent glass tube 35 in which first and second light-emitting areas 37*a* and 37*b* are defined by partitioning an inner space of the glass tube 35 at the center. The first and second light-emitting areas 37*a* and 37*b* extend to longitudinal ends of the transparent glass tube 35. The transparent glass tube 35 is a straight tube having a straight axis and a certain length, and has a circular cross-section. Though not illustrated in FIG. 6, fluorescent material is applied to an inner surface of the transparent glass tube 35.

The cold cathode fluorescent lamp 30 further includes a first terminal electrode 31 positioned in the first light-emitting area 37*a* and at a longitudinal end of the first light-emitting area 37*a* located closer to an end 35*a* of the transparent glass tube 35, a second terminal electrode 34 positioned in the second light-emitting area 37*b* and at a longitudinal end of the second light-emitting area 37*b* located closer to the other end 35*b* of the glass tube 35, a first intermediate electrode 32 positioned in the first light-emitting area 37*a* and at the other longitudinal end of the first light-emitting area 37*a*, a second intermediate electrode 33 positioned in the second light-emitting area 37*b* and at the other longitudinal end of the second light-emitting area 37*b*, a first lead-in wire 36*a* connected to the first terminal electrode 31 through the longitudinal end of the first light-emitting area 37*a*, a second lead-in wire 36*b* connected to the second terminal electrode 34 through the longitudinal end of the second light-emitting area 37*b*, a third lead-in wire 36*c* connected to the first intermediate electrode 32 through the other longitudinal end of the first light-emitting area 37*a*, and a fourth lead-in wire 36*d* connected to the second intermediate electrode 33 through the other longitudinal end of the second light-emitting area 37*b*.

The first terminal electrode 31, the second terminal electrode 34, the first intermediate electrode 32, and the second intermediate electrode 33 are fixed to the glass tube 35. Specifically, the first terminal electrode 31 is fixed to a thick-walled portion 35*c* located at an end of the glass tube 35, the second terminal electrode 34 is fixed to a thick-walled portion 35*d* located at the other end of the glass tube 35, and the first and second intermediate electrodes 32 and 33 are fixed to a thick-walled portion 35*e* located at the center of the glass tube 35.

Figure 1:
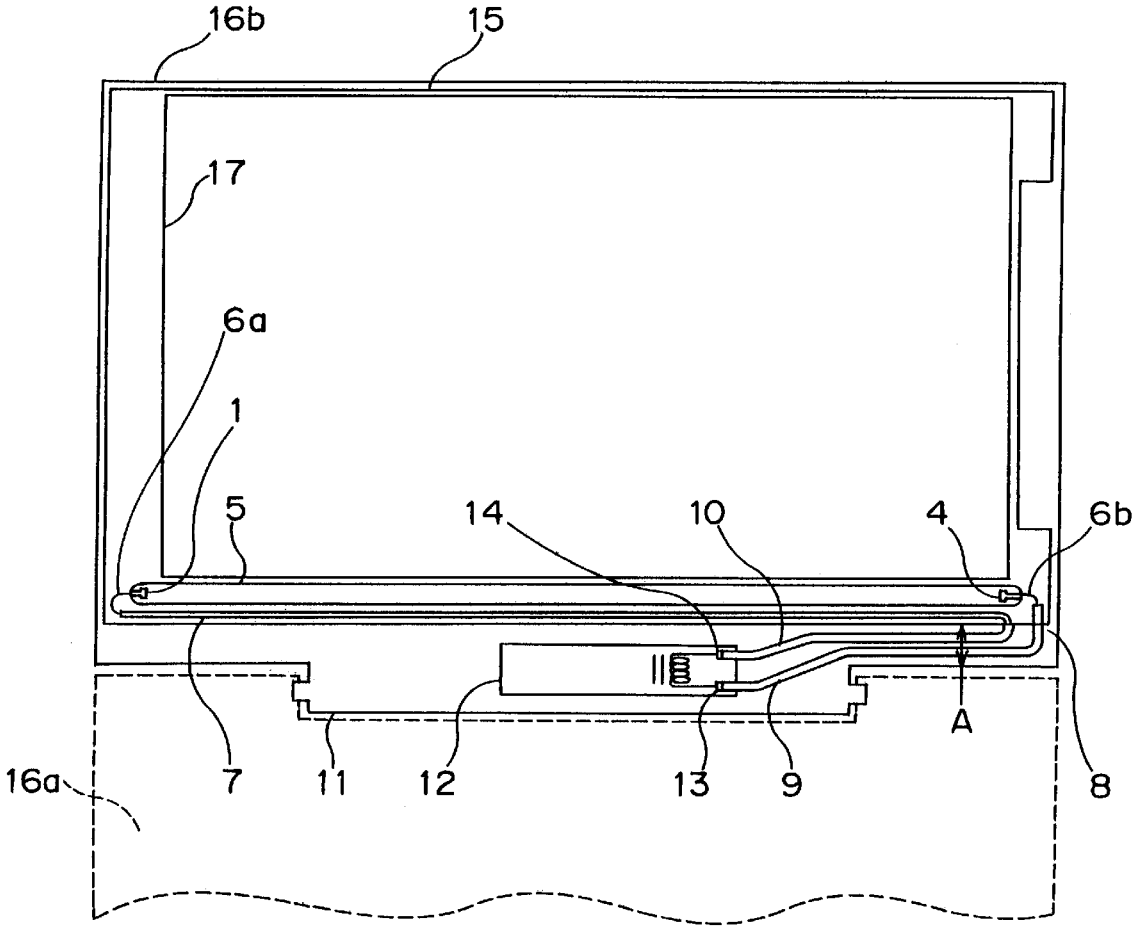
FIG. 1 PRIOR ART
FIG. 1 is a front view illustrating a note-type personal computer including a conventional cold cathode fluorescent lamp.
Figure 2:
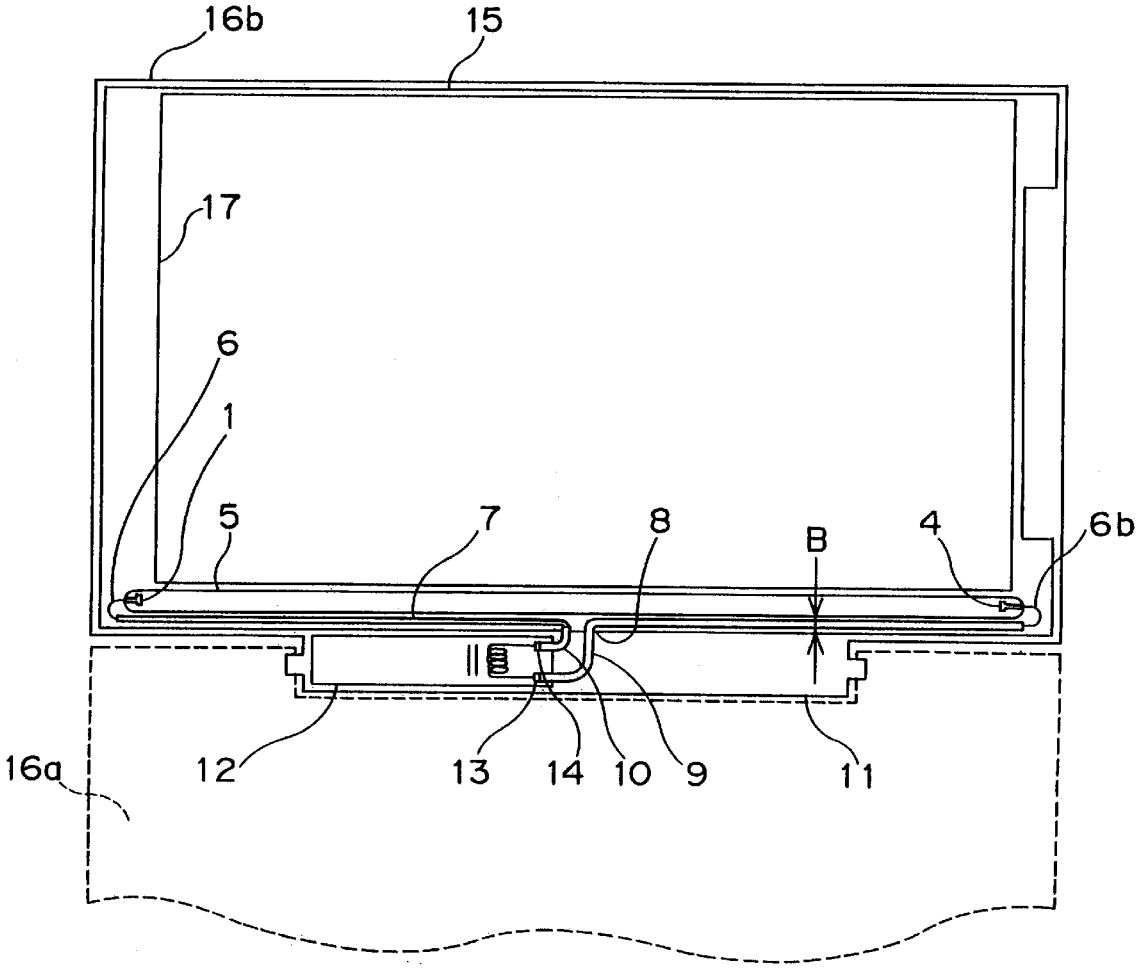
FIG. 2 PRIOR ART
FIG. 2 is a front view illustrating another note-type personal computer including a conventional cold cathode fluorescent lamp.
Figure 3:
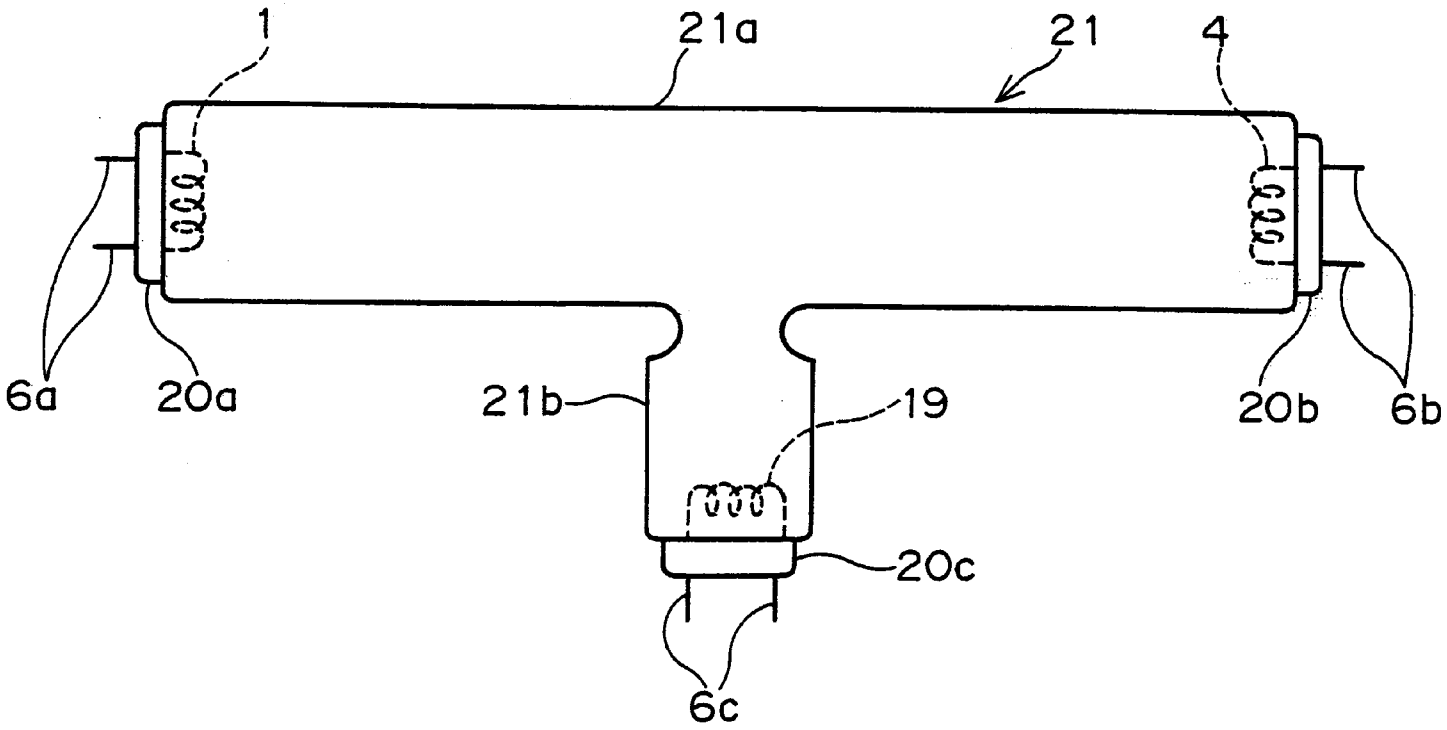
FIG. 3 PRIOR ART
FIG. 3 is a front view illustrating a conventional hot cathode fluorescent lamp including an intermediate electrode.
Figure 4:
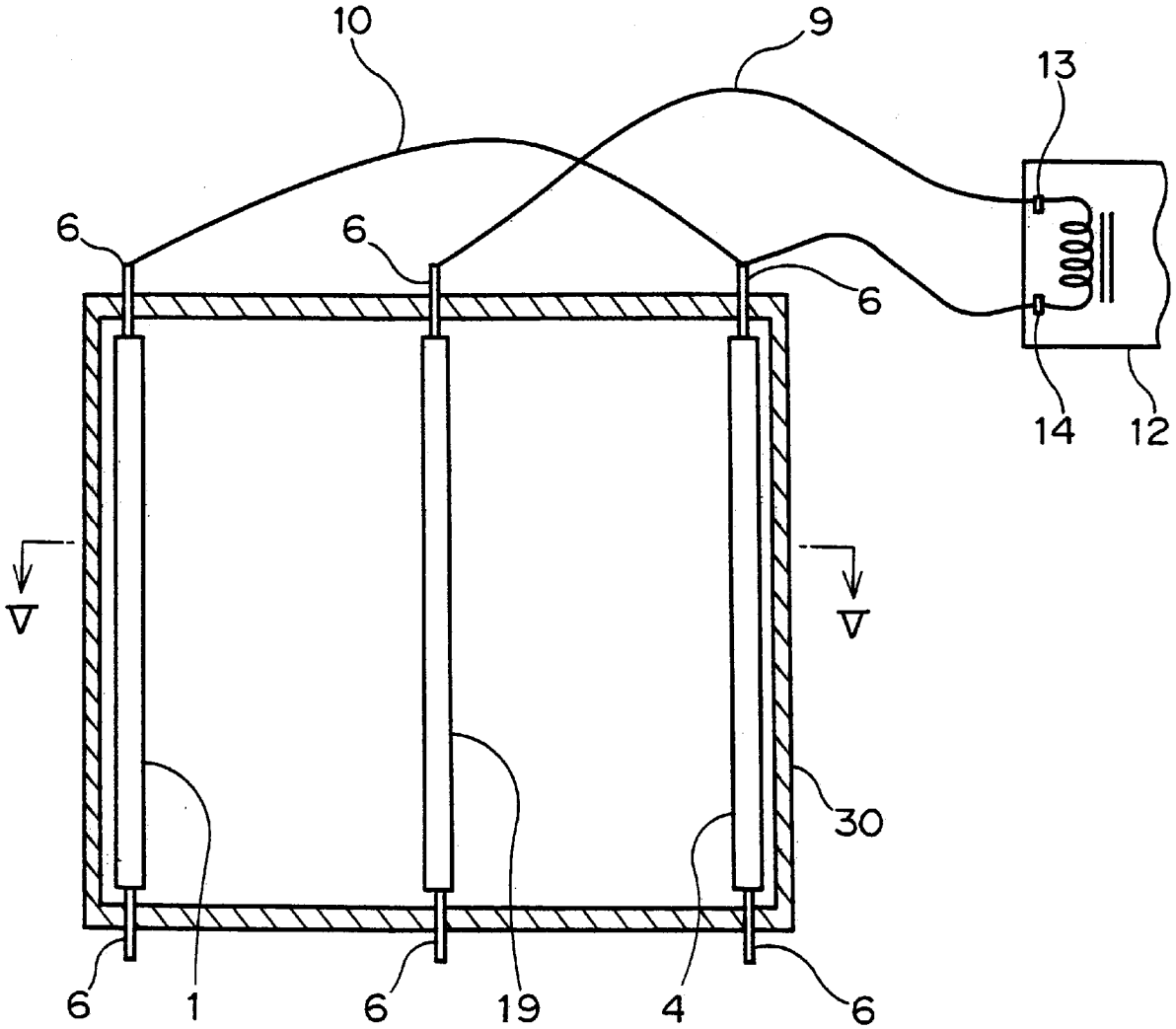
FIG. 4 PRIOR ART
FIG. 4 is a cross-sectional view taken along a light-emitting plane of a conventional planar fluorescent lamp.
Figure 5:
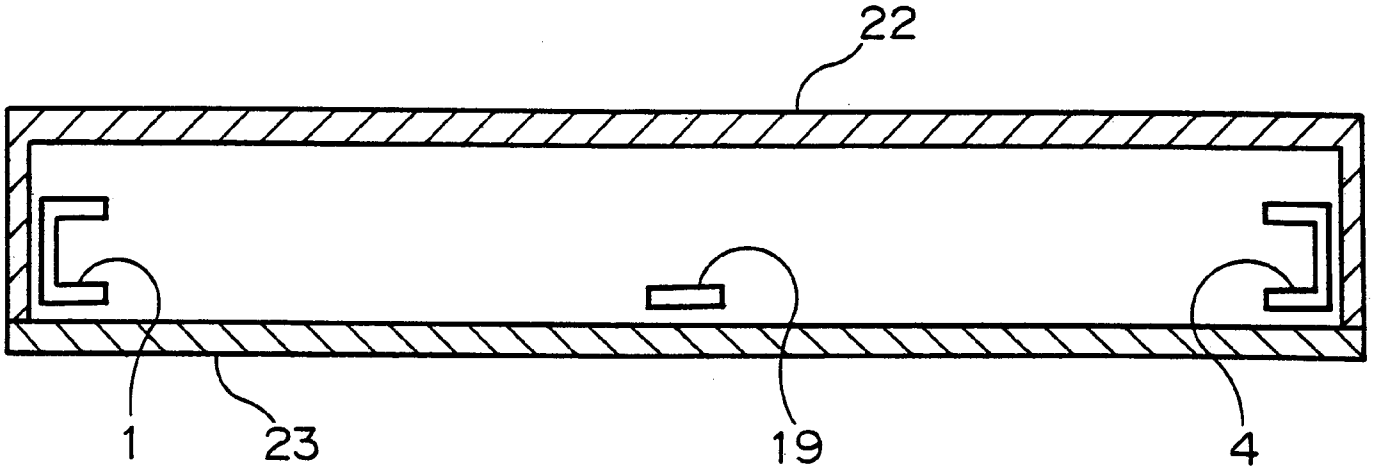
FIG. 5 PRIOR ART
FIG. 5 is a cross-sectional view taken along the line V—V.

Those electrodes 31, 32, 33, and 34 are fixed to the glass tube 35 by fixing a glass ball around each of the lead-in wires 36*a*, 36*b*, 36*c*, and 36*d*, inserting the lead-in wires 36*a*, 36*b*, 36*c*, and 36*d* into the glass tube 35, heating the glass balls to thereby melt the glass balls, cooling the molten glass balls to thereby fix the lead-in wires 36*a*, 36*b*, 36*c*, and 36*d* to the glass tube 35 through the cured glass balls. Hence, it is no longer necessary to prepare a base for fixing an electrode to a glass tube unlike the conventional hot cathode fluorescent lamp illustrated in FIG. 3. The above-mentioned steps for fixing the electrodes 31, 32, 33, and 34 to the glass tube 35 further separates an inside of the glass tube 35 from an outside thereof, and hermetically seals an inside of the glass tube 35 for preventing external air from entering the glass tube 35.

The third and fourth lead-in wires cooperate with each other to form a T-shaped wire, as illustrated in FIG. 6. Specifically, the first intermediate electrode 32 is connected to an end of a first portion 38*a* of the T-shaped wire extending in parallel with a longitudinal axis of the glass tube 35 so that the first intermediate electrode 32 faces the first terminal electrode 31. The second intermediate electrode 33 is connected to the other end of the first portion 38*a* of the T-shaped wire so that the second intermediate electrode 33 faces the second terminal electrode 34. A second portion 38*b* of the T-shaped wire perpendicularly extends from the first portion 38*a* at the center.

Discharge for emitting lights is generated between facing electrodes, namely, between the first terminal electrode 31 and the first intermediate terminal 32, and between the second terminal electrode 33 and the second intermediate terminal 33.

A distance between the first terminal electrode 31 and the first intermediate electrode 32 both defining the first light-emitting area 37*a* therebetween is designed to be equal to a distance between the second terminal electrode 34 and the second intermediate electrode 33 defining the second light-emitting area 37*b* therebetween, in order to equalize discharge voltages in the first and second light-emitting areas 37*a* and 37*b*.

When a high level voltage is applied to the first and second intermediate electrodes 32 and 33, and a low level voltage is applied to the first and second terminal electrodes 31 and 34, residual electrons existing in the glass tube 35 are attracted to the first and second terminal electrodes 31 and 34, and collide with the first and second terminal electrodes 31 and 34. As a result, secondary electrons are emitted from the first and second terminal electrodes 31 and 34, which means discharge starts between the first terminal electrode 31 and the first intermediate electrode 32, and between the second terminal electrode 34 and the second intermediate electrode 33. Hence, the electrodes 31, 32, 33, and 34 may have any shape, unless secondary electrons are efficiently emitted into the first and second light-emitting areas 37*a* and 37*b*, and the electrodes 31, 32, 33, and 34 do not prevent the cold cathode fluorescent lamp 30 from being made in a smaller diameter. It is not necessary for the electrodes 31, 32, 33, and 34 to have a form of a filament for emitting hot electrons therefrom, unlike a hot cathode fluorescent lamp.

Since the lead-in wires 36*a*, 36*b*, 36*c*, and 36*d* are used only for applying a high or low level voltage to the electrodes 31, 32, 33, and 34 therethrough, each of the electrodes 31, 32, 33, and 34 is equipped with at least one lead-in wire. It is not always necessary for each of the electrodes 31, 32, 33, and 34 to have two or more lead-in wires. The glass tube 35 in the above-mentioned embodiment may be L-shaped, U-shaped, or crank-shaped, unless the glass tube 35 satisfies the above-mentioned requirements. It is not always necessary for the glass tube 35 to have a form of a straight tube.

Figure 7:
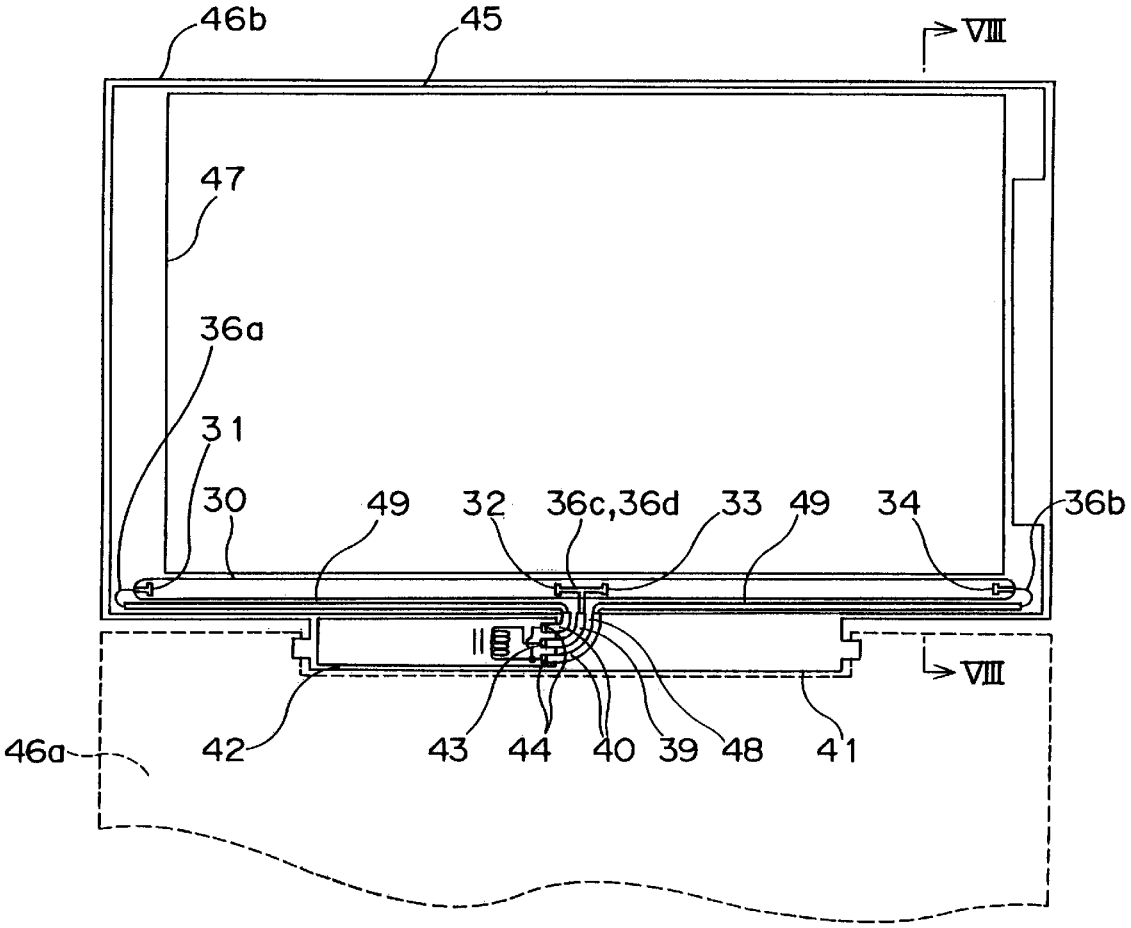
FIG. 7 is a front view illustrating a note-type personal computer including the cold cathode fluorescent lamp illustrated in FIG. 6.
Figure 8:
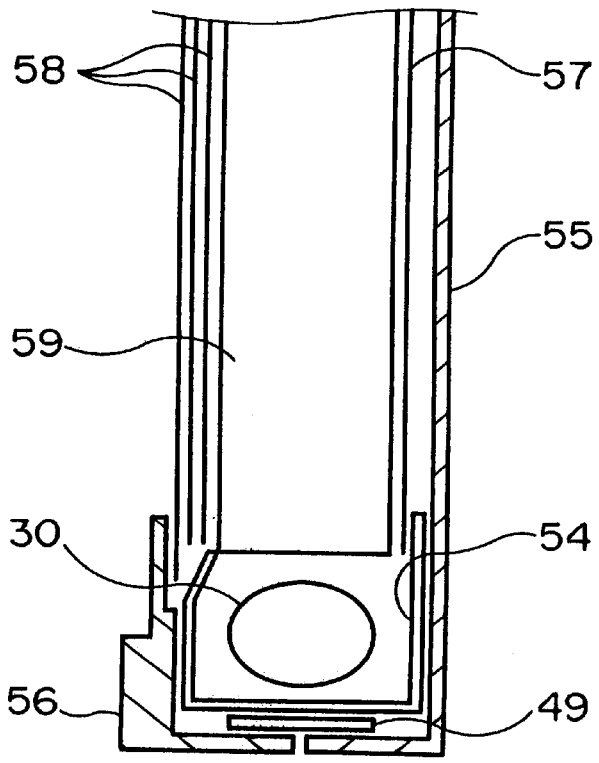
FIG. 8 is a partial cross-sectional view of the note-type personal computer illustrated in FIG. 7, illustrating a backlight emitting device including the cold cathode fluorescent lamp in accordance with the present invention

FIG. 7 illustrates a note-type personal computer including a back-light emitting device having the above-mentioned cold cathode fluorescent lamp 30 as a component. FIG. 8 is a cross-sectional view taken along the line VIII—VIII in FIG. 7.

With reference to FIG. 7, the note-type personal computer is comprised of a first body 46*a* including a structure acting as a computer and an input means such as a keyboard (not illustrated), a second body 46*b* including a display screen 47 which has an outer periphery 45 and on which images are displayed, a hinge structure 41 formed between the first and second bodies 46*a* and 46*b* for connecting the second body 46*b* to the first body 46*a* so that the second body 46*b* is rotatable relative to the first body 46*a*, an inverter 42 housed in the hinge structure 41 almost at the center, and the cold cathode fluorescent lamp 30 housed in the second body 46*b* at a bottom.

The first terminal electrode 31 of the cold cathode fluorescent lamp 30 is electrically connected to a low voltage cable 40 through both the first lead-in wire 36*a* and a thin wire 49, and the low voltage cable 40 is connected to a low voltage terminal 44 of the inverter 42. Similarly, the second terminal electrode 34 is electrically connected to the low voltage cable 40 through both the second lead-in wire 36*b* and the thin wire 49. The first and second intermediate terminals 32 and 33 of the cold cathode fluorescent lamp 30 are electrically connected to a high voltage cable 39 through the third and fourth lead-in wires 36*c* and 36*d*, the high voltage cable 39 is connected to a high voltage terminal 43 of the inverter 42.

As illustrated in FIG. 7, the inverter 42 occupies a left half in an inner pace of the hinge structure 41. A wire port 48 through which the thin wires 49 and the third and fourth lead-in wires 36*c* and 36*d* are connected to the high and low voltage cables 39 and 40 is formed at the center of a bottom edge of the second body 46*b*.

It should be noted that the inverter 42 may occupy a right half in an inner space of the hinge structure 41.

FIG. 8 is a cross-sectional view taken along the line VIII—III in FIG. 7. As illustrated in FIG. 8, the cold cathode fluorescent lamp 30 is positioned just below an end surface of a light guide plate 59 constituting the display screen 47, and is surrounded by a reflector 54. Lens sheets 58 are located in front of the light guide plate 59, and a reflection sheet 57 is located at the rear of the light guide plate 59. First and second outer covers 55 and 56 cover the reflection sheet 57 and the reflector 54, but does not cover the lens sheets 58.

As illustrated in FIG. 8, the thin wire 49 is positioned below and along the cold cathode fluorescent lamp 30 between the reflector 54 and the outer covers 55 and 56. In this embodiment, the thin wire 49 is comprised of a foil-shaped electrical conductor, and an insulator covering the foil-shaped electrical conductor therewith. The foil-shaped electrical conductor is designed to have a thickness and a width in dependence on a current flowing through the cold cathode fluorescent lamp 30 and so that the foil-shaped electrical conductor is not broken, even when the thin wire 49 is bent and/or stretched.

Figure 9:
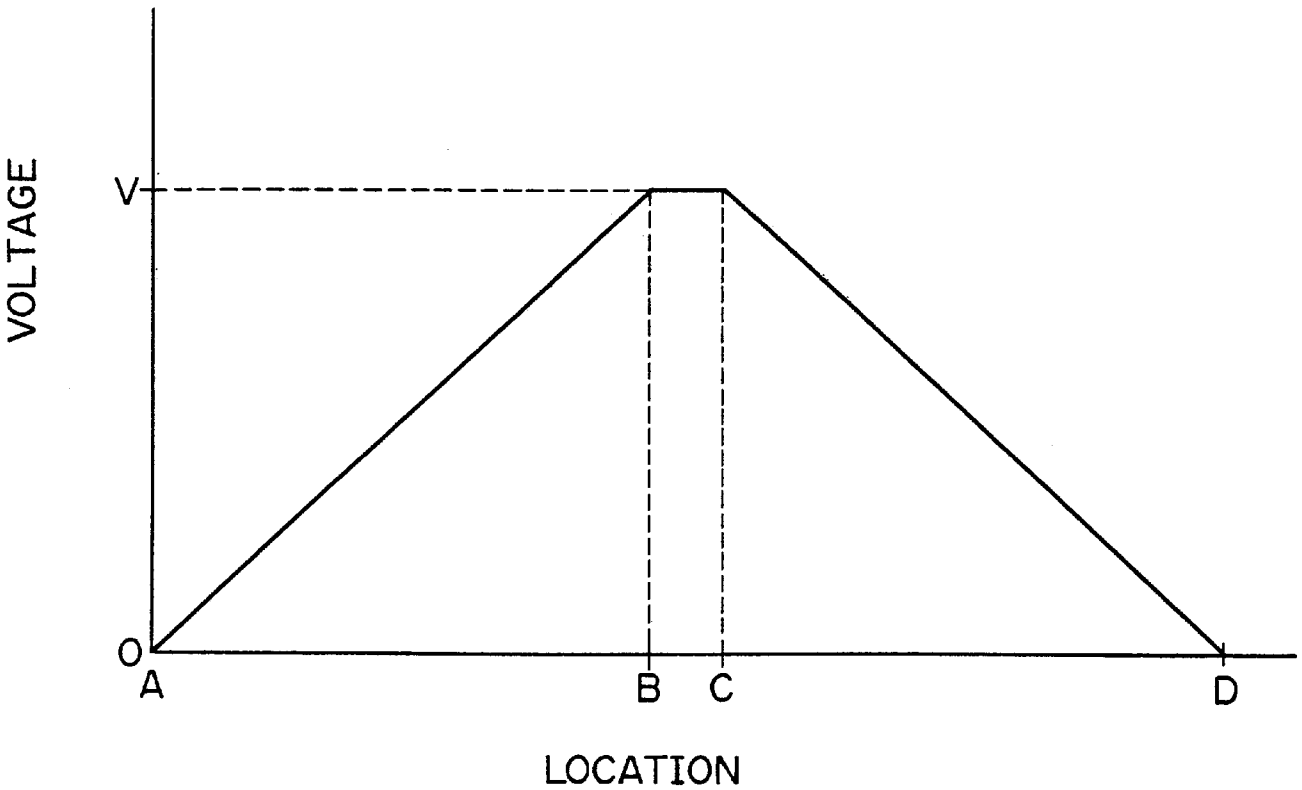
FIG. 9 is a graph showing a voltage profile in a cold cathode fluorescent amp in accordance with a preferred embodiment of the present invention.

FIG. 9 illustrates a voltage profile of the above-mentioned cold cathode fluorescent lamp 30 illustrated in FIG. 6. As mentioned earlier, a lower level voltage is applied to the first and second terminal electrodes 31 and 34, and a higher level voltage is applied to the first and second intermediate electrodes 32 and 33. It is supposed that locations of the electrodes 31, 32, 33, and 34 are represented with letters A, B, C, and D, as illustrated in FIG. 6. A voltage linearly increases from zero to a discharge voltage V between A and B, is kept constant between B and C, and linearly decreases from the discharge voltage V to zero.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-316103 filed on Oct. 31, 1997 including specification, claims, drawings and summary is incorporated herein by reference in its entirety.

What is claimed is:

1. A back-light emitting device comprising:

(a) a light guide plate; and (b) a cold cathode fluorescent lamp positioned adjacent to an end surface of said light guide plate, said cold cathode fluorescent lamp including:

(a) a transparent tube including first and second light-emitting areas defined by physically partitioning an inner space of said transparent tube at the center, and extending to longitudinal ends of said transparent tube;

(b) a first terminal electrode positioned in said first light-emitting area and at a longitudinal end of said first light-emitting area located closer to an end of said transparent tube;

(c) a second terminal electrode positioned in said second light-emitting area and at a longitudinal end of said second light-emitting area located closer to the other end of said transparent tube;

(d) a first intermediate electrode positioned in said first light-emitting area and at the other longitudinal end of said first light-emitting area;

(e) a second intermediate electrode positioned in said second light-emitting area and at the other longitudinal end of said second light-emitting area;

(f) a first lead-in wire connected to said first terminal electrode through said longitudinal end of said first light-emitting area;

(g) a second lead-in wire connected to said second terminal electrode through said longitudinal end of said second light-emitting area;

(h) a third lead-in wire connected to said first intermediate electrode through said other longitudinal end of said first light-emitting area; and (i) a fourth lead-in wire connected to said second intermediate electrode through said other longitudinal end of said second light-emitting area, a lower level voltage being applied to said first and second terminal electrodes, and a higher level voltage being applied to said first and second intermediate electrodes.

2. The back-light emitting device as set forth in claim 1, wherein said inner space of said transparent tube is partitioned at the center, and said first and second light-emitting areas extend to longitudinal ends of said transparent tube.

3. The back-light emitting device as set forth in claim 1, wherein said third and fourth lead-in wires form a T-shaped wire.

4. The back-light emitting device as set forth in claim 1, wherein a distance between said first terminal electrode and said first intermediate electrode is equal to a distance between said second terminal electrode and said second intermediate electrode.

5. The back-light emitting device as set forth in claim 1, wherein said back light device is installed in a personal computer have a liquid crystal display.

* * * * *